US007156673B2

(12) United States Patent
Son

(10) Patent No.: US 7,156,673 B2
(45) Date of Patent: Jan. 2, 2007

(54) APPARATUS FOR CONNECTING TO AN ELECTRICAL SOURCE

(75) Inventor: Young-Chul Son, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/184,384

(22) Filed: Jul. 18, 2005

(65) Prior Publication Data

US 2006/0019519 A1 Jan. 26, 2006

(30) Foreign Application Priority Data

Jul. 20, 2004 (KR) ..... 10-2004-0056560

(51) Int. Cl.
*H01R 13/44* (2006.01)

(52) U.S. Cl. ..... 439/131; 439/640

(58) Field of Classification Search ..... 439/131, 439/172, 173, 174, 518, 640
See application file for complete search history.

(56) References Cited

U.S. PATENT DOCUMENTS 5,160,879 A * 11/1992 Tortola et al. ..... 320/111
6,089,886 A 7/2000 Mareno et al.
6,089,921 A * 7/2000 Chou ..... 439/640
6,270,364 B1 * 8/2001 Wang ..... 439/131
6,325,646 B1 12/2001 Uemura et al.
6,722,900 B1 * 4/2004 Segawa et al. ..... 439/131
2003/0045143 A1 3/2003 Chen
2004/0209499 A1 * 10/2004 Chung ..... 439/131
2006/0089026 A1 * 4/2006 Song ..... 439/131

FOREIGN PATENT DOCUMENTS

DE 102 35 207 A1 4/2003

* cited by examiner

*Primary Examiner*—Thanh-Tam Le
(74) *Attorney, Agent, or Firm*—Lee, Hong, Degerman, Kang & Schmadeka

(57) ABSTRACT

An apparatus is disclosed for connecting a power supply to an electronic device. The apparatus comprises a first case having an insertion opening and a plurality of terminal-receiving grooves extending outwardly from an inner circumference of the insertion opening. A second case is coupled to the first case to form a receiving space. A rotary member is rotatably inserted in the insertion opening and having slots formed on at least one surface to align with the terminal-receiving grooves of the first case when the rotary member is turned in a first direction in a predetermined angle. A plug terminal assembly installed in the rotary member. In a first state, the plug terminal assembly is positioned approximately vertically upward. In a second state, the plug terminal assembly collapses to an approximately horizontal position.

24 Claims, 7 Drawing Sheets

APPARATUS FOR CONNECTING TO AN ELECTRICAL SOURCE

CROSS-REFERENCE TO RELATED APPLICATIONS

Pursuant to 35 U.S.C. § 119(a), this application claims the benefit of earlier filing date and right of priority to Korean Application No. 56560/2004, filed on Jul. 20, 2004; the contents of which are hereby incorporated by reference herein in their entirety.

FIELD OF THE INVENTION

The present invention relates to an apparatus for connecting electrical sources and more particularly, to an apparatus connecting electrical sources to an electrical device with an improved structure for folding and unfolding a plug terminal.

BACKGROUND OF THE INVENTION

FIG. 1 is a perspective view that illustrates a related art electrical connecting apparatus, such as a power adapter having a collapsible two-pronged plug. FIG. 2 is a section view that illustrates the related art electrical connecting apparatus. The related art electrical connecting apparatus includes a case 21, and a plug terminal 22 installed at a front surface of the case 21. The plug terminal 22 is rotatable about a hinge portion 22*a*.

Within the case 21, a circuit board 23 couples to the plug terminal 22. The circuit board 23 converts a high voltage into a low voltage. The plug terminal 22 may be connected to a power supply unit C, such as a wall mount electrical socket to receive the high voltage.

Extending out of the case 21, an output terminal 24 connected to the circuit board 23 outputs the low voltage. The low voltage may be used to power an electronic device, not shown, such as a mobile communication terminal. Formed on the case 21, a rectangular plug-receiving cavity 25 receives the plug terminal 22 in a folded position.

In the related art electrical connecting apparatus, the plug terminal 22 after an extended period of use becomes loose rotates in an undesirable direction. This causes inconvenience to the user when inserting the plug terminal into a wall socket.

Thus, there is a need for an improved electrical connecting apparatus that is more robust and provides advantages and more convenience to a user.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

An object of the present invention is to provide an electrical connecting apparatus that provides simplified folding and unfolding of a plug terminal. Another object of the present invention is to provide simplified folding and unfolding of the plug terminal to improve a user's convenience. Another object of the present invention is to improve reliability of an electrical connecting apparatus by maintaining firmness of the plug terminal after repeated folding and unfolding.

In one embodiment, an apparatus is disclosed for connecting a power supply to an electronic device. The apparatus comprises a first case having an insertion opening and a plurality of terminal-receiving grooves extending outwardly from an inner circumference of the insertion opening. A second case couples to the first case to form a receiving space. A rotary member is rotatably inserted in the insertion opening and having slots formed on at least one surface to align with the terminal-receiving grooves of the first case when the rotary member is turned in a first direction in a predetermined angle.

A plug terminal assembly installed in the rotary member. In a first state, the plug terminal assembly is positioned approximately vertically upward in relation with a top surface of the first case. In a second state, the plug terminal assembly collapses to an approximately horizontal position in relation to the top surface of the first case such that terminal ends of the plug terminal assembly are positioned in the terminal-receiving grooves when the rotary member is turned in the first direction in the predetermined angle.

In a second embodiment, a collapsible plug assembly is disclosed. The assembly comprises a first case having an insertion opening and a plurality of terminal-receiving grooves extending from an inner circumference of the insertion opening. A second case couples to the first case to form a receiving space. A boss portion is extended from inside the second case to correspond with the insertion opening. A rotary member is rotatably inserted in the insertion opening and having slots formed on at least one surface to align with the terminal-receiving grooves of the first case when the rotary member is turned in a first direction in a predetermined angle.

A plug terminal assembly is installed in the rotary member. In a first state, the plug terminal assembly is positioned approximately vertically upward in relation with a top surface of the first case. In a second state, the plug terminal assembly collapses to an approximately horizontal position in relation to the top surface of the first case such that terminal ends of the plug terminal assembly are positioned in the terminal-receiving grooves when the rotary member is turned in the first direction in the predetermined angle.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

Reference will now be made in detail to the preferred embodiments of the present invention, examples of which are illustrated in the accompanying drawings.

Figure 1:
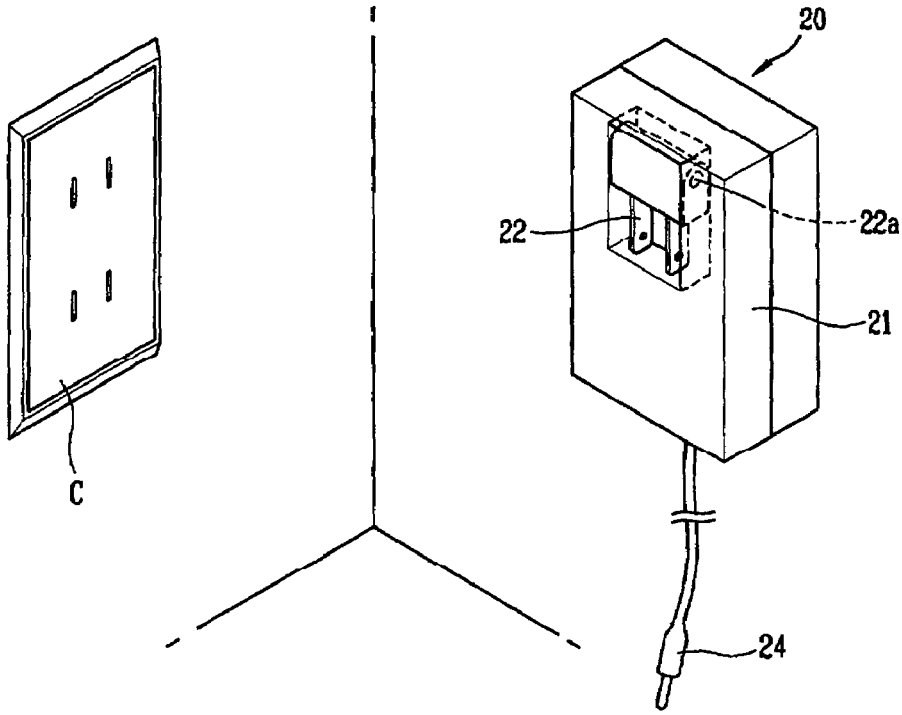
FIG. 1 RELATED ART
FIG. 1 is a perspective view that illustrates an electrical connecting apparatus in accordance with the related art.
Figure 2:
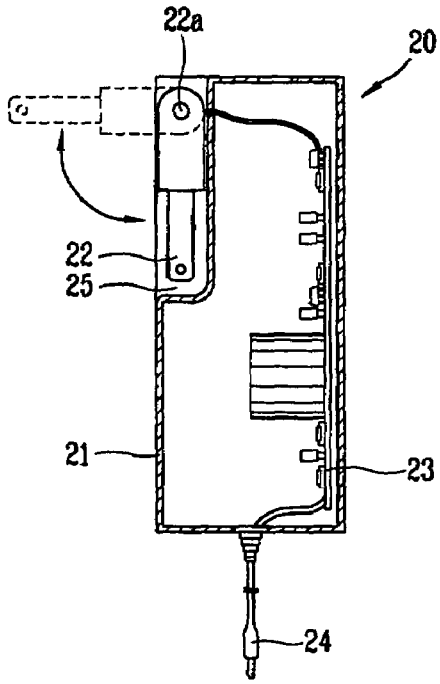
FIG. 2 RELATED ART
FIG. 2 is a sectional view that illustrates the electrical connecting apparatus in accordance with the related art.
Figure 3:
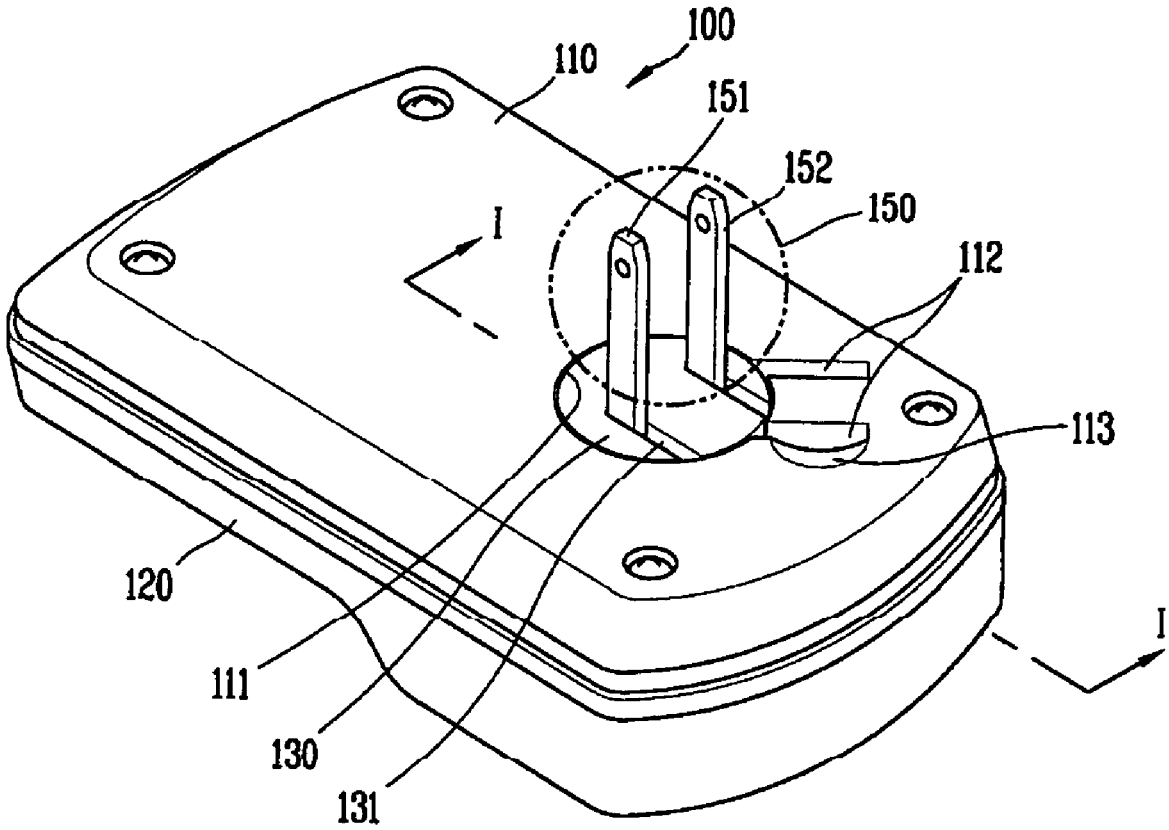
FIG. 3 is a perspective view that illustrates an electrical connecting apparatus in accordance with one embodiment of the present invention.
Figure 4:
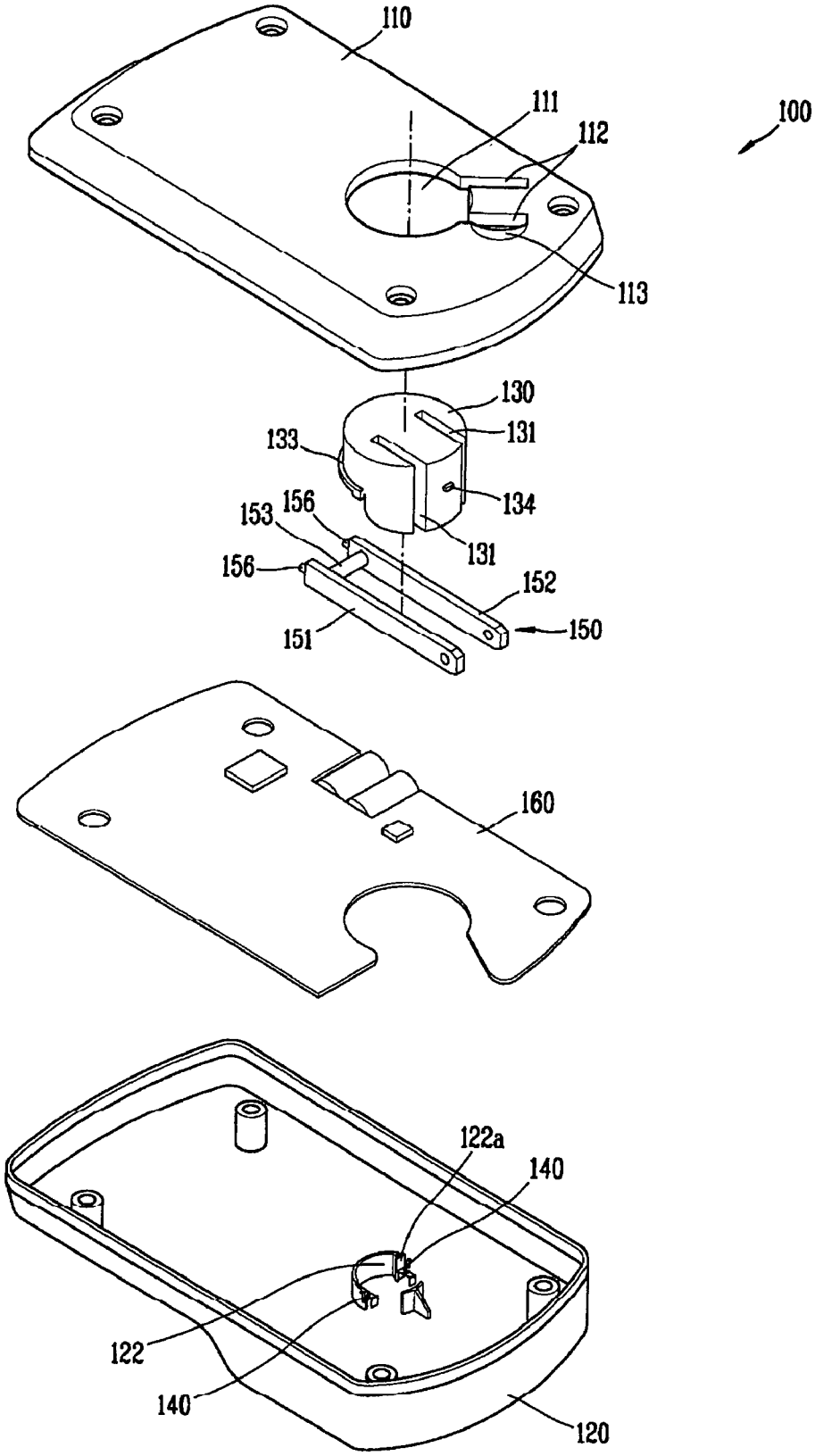
FIG. 4 is an exploded perspective view of the electrical connecting apparatus of FIG. 3 in accordance with one embodiment of the present invention.

Referring to FIGS. 3 and 4, the electrical connecting apparatus 100 comprises a first case 110, a second case 120, and a rotary member 130. An insertion opening 111 for the rotary member 130 is provided proximal to a central portion of the first case 110. A plurality of terminal-receiving grooves 112 extends from an inner circumference surface of the insertion opening 111. The first case 110 couples to a second case 120 to form a receiving space therein. A boss portion 122 extends upward from the inner surface of second case 120, as shown in FIG. 4.

The boss portion 122 corresponds to the insertion opening 111. A rotary member 130 is rotatably installed within the insertion opening 111 of the first case 110. Slots 131 are disposed within the rotary member 130, preferable parallel to each other. Slots 131 line up with the terminal-receiving grooves 112 when the rotary member is rotated in a first direction in a predetermined or specified angle.

Connection plates 140 installed at the boss portion 122 of the second case 120 connect to a printed circuit board 160. A plug terminal assembly 150, comprising for example a pair of elongated electric terminals, is rotatably installed at a bottom portion of the rotary member 130.

In one embodiment, a first portion of the assembly 150, when installed, contacts each of the connection plates 140. A second portion of the assembly 150 penetrates the insertion opening 111 of the first case 110 for exposing the plug terminal assembly 150 outside of the first case 110.

Figure 6:
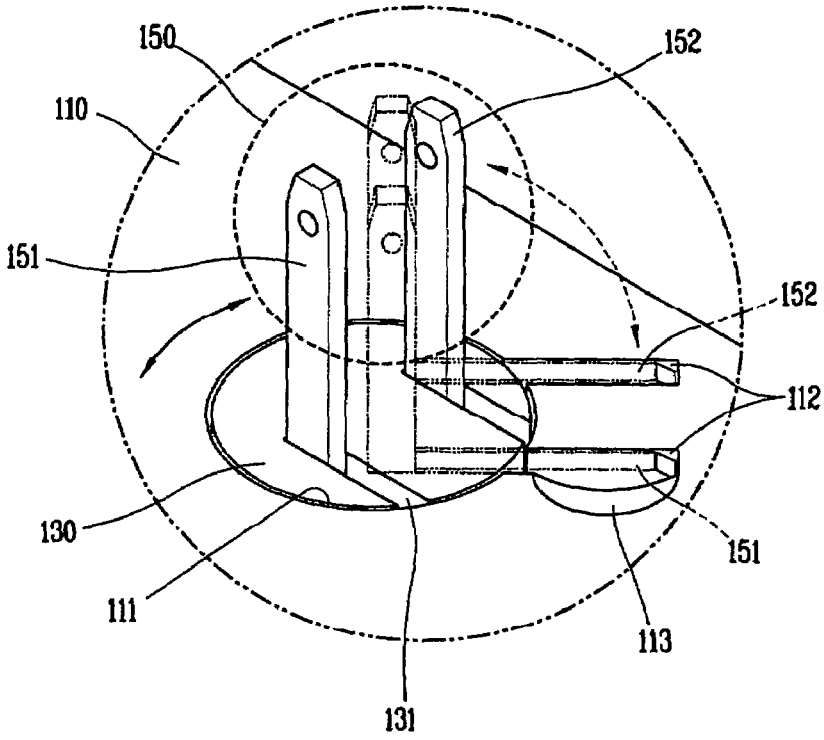
FIG. 6 is an enlarged perspective view that illustrates a plug terminal assembly of the electrical connecting apparatus in folded and unfolded states, in accordance with one embodiment of the present invention.

Referring to FIGS. 4 and 6, a finger insertion groove 113 is preferably formed at the terminal-receiving grooves 112 to allow a user conveniently unfold the plug terminal assembly 150 when it is in a folded state. The finger insertion groove 113 is deep enough to allow for the tip of a user's finger to come in contact with the plug terminal assembly 150, when it is in a folded state. In a preferred embodiment, the finger insertion groove 113 is approximately 10 mm wide.

Referring back to FIG. 4, a flange 133 is disposed around an outer edge of the rotary member 130. While inserted in the insertion opening 111, the flange 133 prevents the rotary member 130 from unintentionally slipping out from the first case 110.

Figure 5:
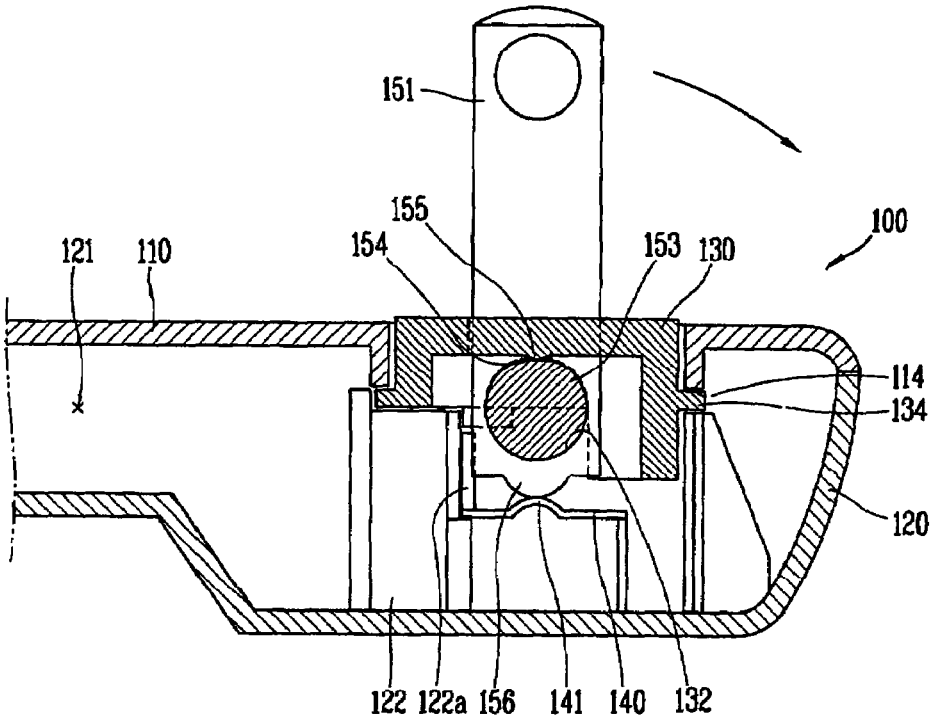
FIG. 5 is a sectional view taken along line I—I of FIG. 3.

Referring to FIG. 5, inside the first case 110, a stopping groove 114 is formed near the insertion opening 111. A stopper 134 is formed at an outer circumferential surface of the rotary member 130. The stopper 134 corresponds with the stopping groove 114. When a user rotates the rotary member 130 to fold or unfold the plug terminal assembly 150, a rotating angle of the rotary member 130 is restricted. Preferably, the rotary member 130 is restricted to a maximum predetermined angle. The plug terminal assembly 150 provides two elongated electric terminals: a first terminal 151 and a second terminal 152. The first and second terminals 151, 152 insert into the slots 131*a*, 131*b* of the rotary member 130.

Referring to FIGS. 4 and 5, a shaft 153, formed of an insulation material, for example, connects the first terminal 151 with the second terminal 152. The shaft can be rotatably inserted into a shaft groove 132 of the rotary member 130. A groove 154 is formed in the middle of the shaft 153. A protrusion 155 is formed at the rotary member 130, which corresponds with the groove 154.

In the unfolded state, when the protrusion 155 is inserted in the groove 154, the plug terminal assembly 150 firmly maintains the unfolded state. First connection protrusions 156 are formed at a first end of the first and second terminals 151, 152. Second connection protrusions 141 are formed at each of the connection plates 140 corresponding to the first connection protrusions 156.

In the unfolded state, the first connection protrusions 156 contact the second contact protrusions 141. A second end of each of the first and second terminals 151, 152 pass through the insertion opening 111 of the first case 110 to extend outside of the first case 110. In the folded state, the first connection protrusions 156 of the first and second terminals 151,152 do not contact the second connection protrusions 141. That is, the second end of each of the first and second terminals 151,152 is inserted in the terminal-receiving grooves 112, respectively. As the rotary member 130 is rotated, each of the slots 131*a*, 131*b* of the rotary member 130 is aligned with a corresponding terminal-receiving groove 112, thus, allowing the folding of the plug terminal assembly 150.

Referring to FIGS. 4–6, the procedure for folding and unfolding the plug terminal assembly 150 is herein described. As shown in FIG. 6, a plug terminal assembly 150 is depicted as dotted lines in the folded state. To unfold the plug terminal assembly 150, the user puts a finger in the finger insertion opening 113 and flips upward the first terminal 151. In this example, because the shaft 153 is rotatably connected with the shaft groove 132, the plug terminal assembly 150 rotates about the shaft 153 so that both the first and second terminals 151, 152 extend approximately vertically upward in relation to outer surface of the first unit 110.

When the plug terminal assembly 150 is completely rotated, the protrusion 155 is inserted in the groove 154, thereby firmly maintaining the unfolded state of the plug terminal assembly 150. As a user rotates the plug terminal assembly 150 in a clockwise direction, for example, the rotary member 130 rotates clockwise. The slots 131 of the rotary member 130 become distally located from the terminal-receiving grooves 112 causing a contact to be maintained between the first contact protrusions 153 and the second contact protrusions 141. In the unfolded state, a support portion 112 supports the plug terminal assembly 150, thereby firmly maintaining the unfolded state.

To change the plug terminal assembly 150 from the unfolded to the folded state, the user rotates the plug terminal assembly 150 counterclockwise, for example. The rotary member 130 rotates in a counter-clockwise direction a result. The slots 131 of the rotary member 130 align with the terminal-receiving grooves 112. In the folded state, the first contact protrusions 153 do not contact the second contact protrusions 141. Consequently, when a user presses on the first terminal 151 or the second terminal 152, the plug terminal assembly 150 rotates about the shaft 153 because the shaft 153 is rotatably inserted in the shaft groove 132 of the rotary member 130. When the plug terminal assembly 150 is completely rotated, the first terminal 151 and the second terminal 152 are received in the terminal-receiving grooves 112.

Figure 7:
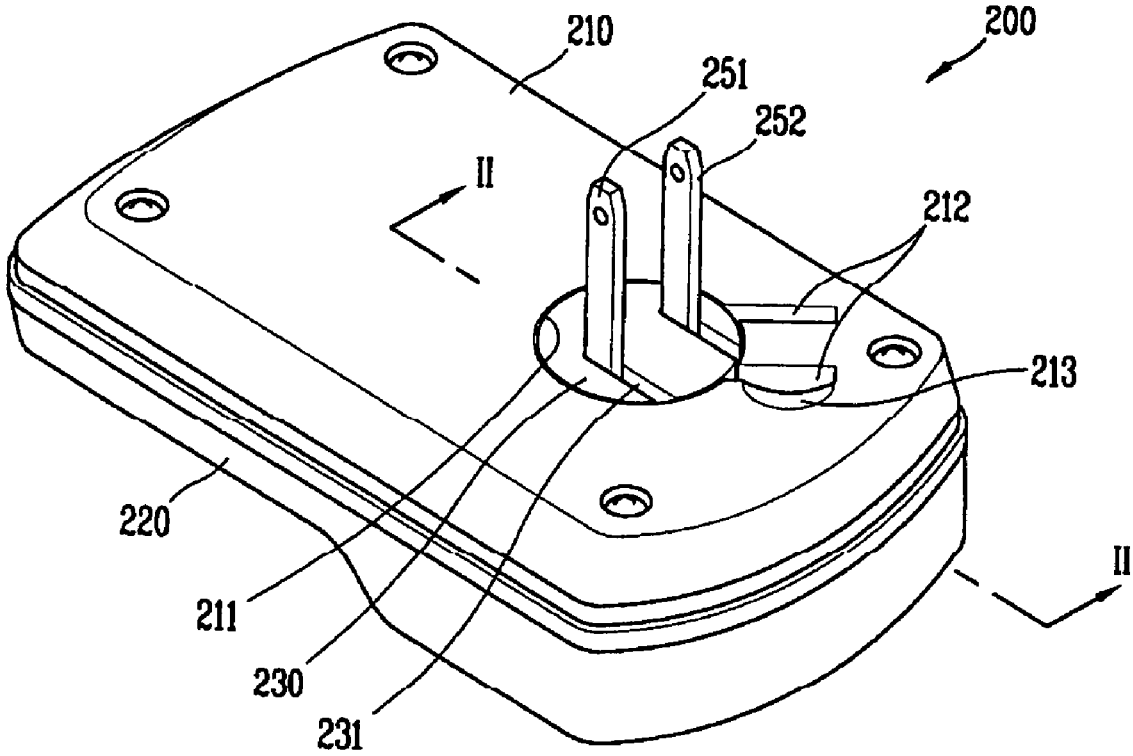
FIG. 7 is a perspective view that illustrates an electrical connecting apparatus in accordance with another embodiment of the present invention.

Referring to FIG. 7, the electrical connecting apparatus 200 in accordance with another embodiment of the present invention comprises a first case 210, a second case 220, and a rotary member 230. The first case 210 has an insertion opening 211 proximate to the center. In addition, the first case 210 has a plurality of terminal-receiving grooves 212 extending outward from the inner circumference of the insertion opening 211. The first case 210 is coupled to the second case 220 to form a receiving space.

Figure 8:
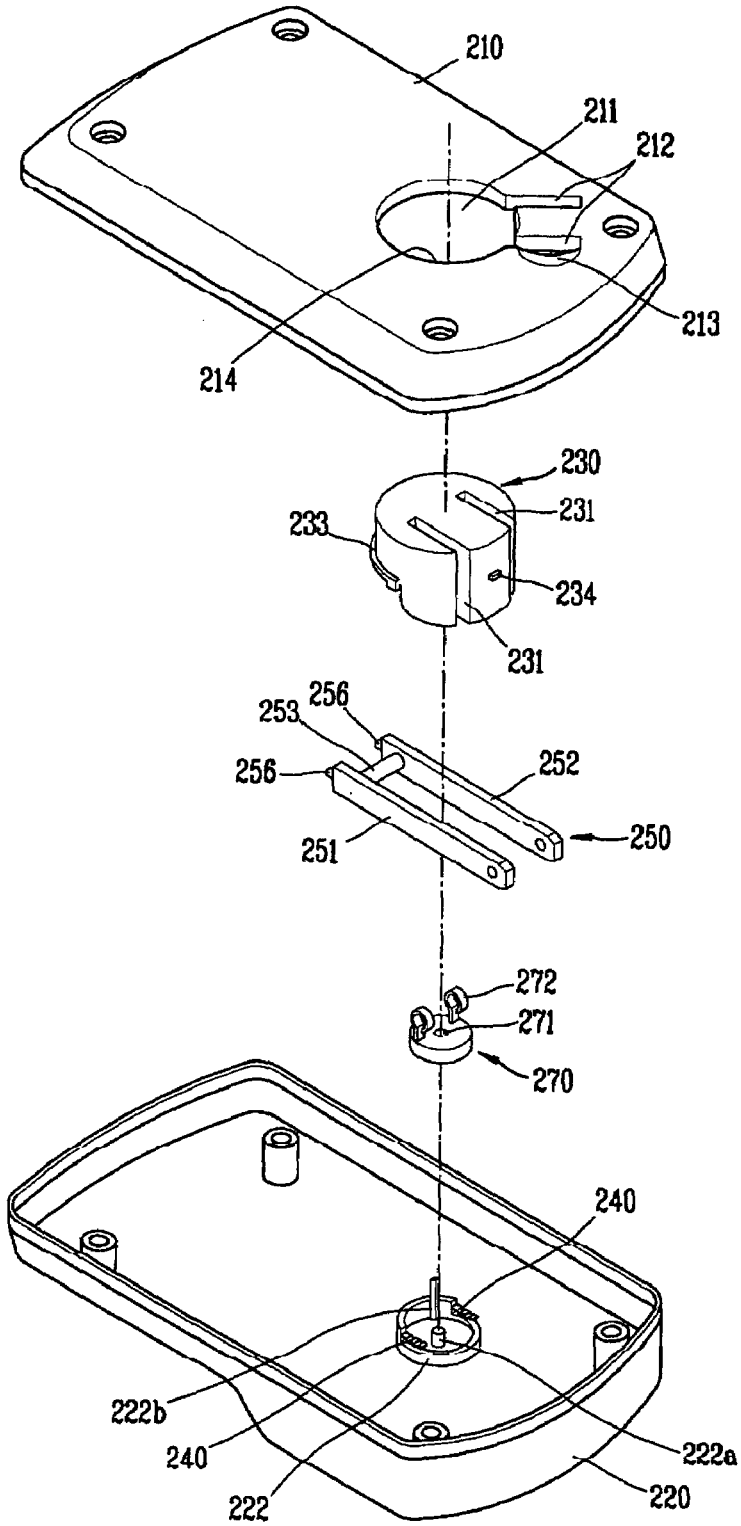
FIG. 8 is an exploded perspective view that illustrates the electrical connecting apparatus in accordance with another embodiment of the present invention.

Referring to FIG. 8, a boss portion 222, in this example ring-shaped, extends from interior surface of the second case 220 to correspond with the insertion opening 211. A rotary member 230 is rotatably installed within the insertion opening 211 of the first case 210. Slots 231 are disposed within the rotary member 230 and correspond to the terminal-receiving grooves 212. Connection plates 240 are installed at both sides of the boss portion 222 of the second case 220. The connection plates 240 contact a printed circuit board 260 and a plug terminal assembly 250 inserted in the rotary member 230.

One end (lower portion) of the rotary member 230 contacts each of the connection plates 240. The other end (upper portion) of the rotary plate 230 passes through the insertion opening 211 of the first case 210 so as to pass through outside of the first case 210. A terminal support member 270, installed in the boss portion 222, rotatably supports the plug terminal assembly 250. Preferably, a finger insertion groove 213 is formed at the terminal-receiving groove 211 so that a user may conveniently fold or unfold the plug terminal assembly 250.

As for a structure of the rotary member 230, a flange 233 is formed around an outer circumference of the rotary member 230. The flange 233 secures the rotary member 230 while rotatably inserted in the insertion opening 211 to the first case 210. A stopping groove 214 is formed inside the first case 210 near the insertion opening 211. At an outer circumferential surface of the rotary member 230, a stopper 234 is formed to correspond with the stopping groove 214. When a user rotates the rotary member 230 to fold or unfold the plug terminal assembly 250, a rotating angle of the rotary member 230 is restricted, namely, the rotary member 230 may be rotated only up to a specified angle.

The plug terminal assembly 250 includes two terminals: a first terminal 251 and a second terminal 252. The first terminal 251 and the second terminal 252 are inserted in the slots 231 of the rotary member 230. A shaft 253 formed of an insulation material, for example, connects the first terminal 251 with the second terminal 252. A connection protrusion 256 is formed at first end of each of the first and second terminals 251 and 252. A plurality of connection grooves 241, which are formed at each connection plate 240, correspond to the connection protrusion 256.

In the unfolded state of the plug terminal assembly 250, the connection protrusions 256 of the first and second terminals 251 and 252 elastically contact the connection grooves 241. Second ends of each of the first and second terminals 251,252 detachably insert into the insertion opening 211 to extend outside of the first case 210.

In the folded state of the plug terminal assembly 250, the contact protrusions 256 of the first and second terminals 251, 252 do not contact the connection grooves 241. In the folded state, the end portions of the first and second terminals 251, 252 are inserted in the terminal-receiving grooves 212 of the first case 210.

As a user rotates the rotary member 230, each of the slots 231 of the rotary member 230 are selectively aligned with terminal-receiving grooves 212 of the first case 210, thereby providing for folding of the plug terminal assembly 250. A shaft 222*a* is preferably formed at the central location of the boss portion 222. A shaft hole 271 is formed at the center of the terminal support member 270, corresponding to the shaft 222*a*. Coupling rings 272 are formed at sides of the terminal support member 270. Coupling rings 272 insert along the end of the shaft 253 of the plug terminal assembly 250. A support portion 222*b* is formed at the boss portion 222. The support portion 222*b* supports the unfolded state of the plug terminal assembly 250.

Figure 9:
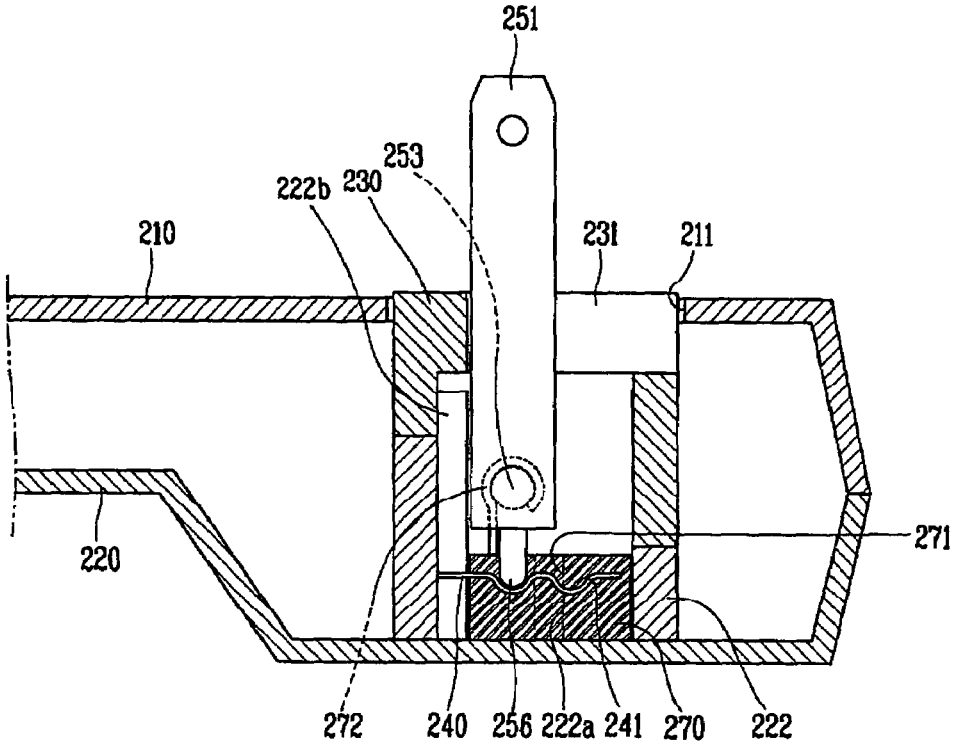
FIG. 9 is a sectional view taken along line II—II of FIG. 7.
Figure 10:
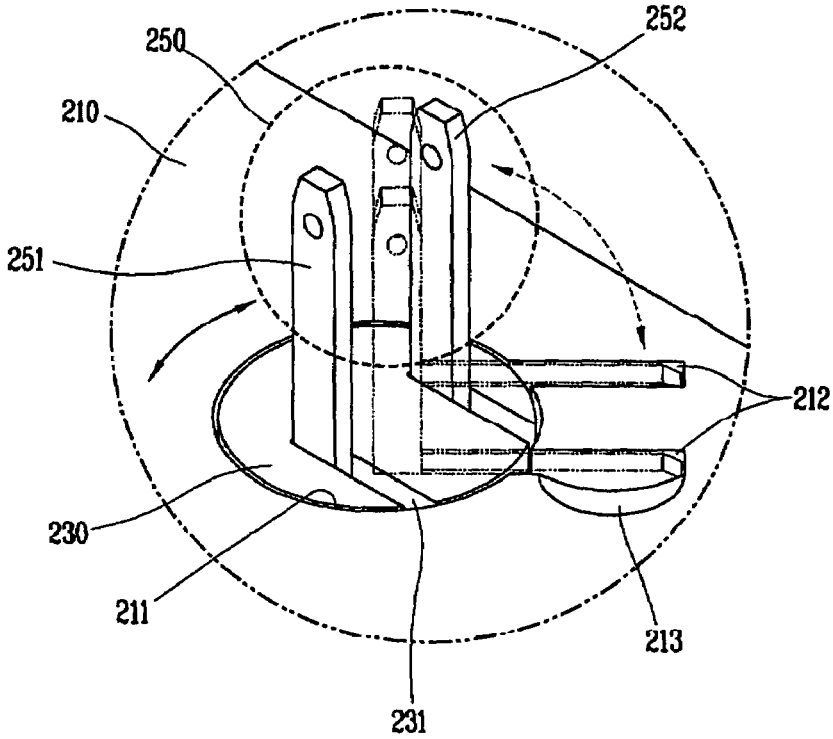
FIG. 10 is an enlarged perspective view that illustrates a folded/unfolded state of a plug terminal assembly of the electrical connecting apparatus in accordance with another embodiment of the present invention.

Referring to FIGS. 9 and 10, operation of the electrical connecting apparatus in accordance with an embodiment of the present invention is disclosed. As shown, a dotted line in FIG. 10 depicts the plug terminal assembly 250 in a folded state. To move the plug terminal assembly 250 from the folded state to the unfolded state, a user inserts his/her finger in the finger insertion opening 213 and pulls the first terminal 251 in an upward fashion. Because the shaft 253 is rotatably inserted in the rings 272 of the terminal support member 270, the plug terminal assembly 250 rotates about the shaft 253.

When the user rotates the plug terminal assembly 250 in a clockwise direction, for example, the rotary member 230 and the terminal support member 270 rotate clockwise. Afterwards, the slots 231 of the rotary member 230 from the terminal-receiving grooves 212 elastically contact the contact protrusions 256 while being secured within the contact grooves 241. The support portion 222*b*, which is formed at the boss portion 222, and the contact grooves 241, serve to firmly maintain the unfolded state of the plug terminal assembly 250.

To change to the folded state from the unfolded state, which is depicted in FIG. 10 as a solid line, a user rotates the plug terminal assembly 250 counterclockwise, for example, to rotate the rotary member 230 in a counterclockwise direction. The slots 231 of the rotary member 230 are linearly aligned with the terminal-receiving grooves 212. In the folded state, the contact protrusions 256 are maintained to prevent contact the terminal-receiving grooves 212.

If the user presses down on the first terminal 251 or the second terminal 252, the plug terminal assembly 250 is rotated about the shaft 253 because the shaft 253 is rotatably inserted in the rings 271 of the terminal support member 270. When the plug terminal assembly 250 is completely rotated, the first terminal 251 or the second terminal 252 is received in the terminal-receiving grooves 212. As the first terminal 251 or the second terminal 252 is received in the terminal-receiving grooves 212, the electrical connecting apparatus 200 can be simply and easily maintained.

As described, the present invention the folding and unfolding of the plug terminal is very easily performed. In addition, the present invention provides for the unfolded state of the plug terminal to be firmly maintained. This improvement increases a user's convenience and reliability when utilizing a plug terminal.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for connecting a power supply to an electronic device, the apparatus comprising:

a first case having an insertion opening and a plurality of terminal-receiving grooves extending outwardly from an inner circumference of the insertion opening;

a second case coupled to the first case to form a receiving space;

a rotary member rotatably inserted in the insertion opening and having slots formed on at least one surface to align with the terminal-receiving grooves of the first case when the rotary member is turned in a first direction in a predetermined angle; and a plug terminal assembly installed in the rotary member so that in a first state the plug terminal assembly is positioned approximately vertically upward in relation with a top surface of the first case, and in a second state the plug terminal assembly collapses to an approximately horizontal position in relation to the top surface of the first case such that terminal ends of the plug terminal assembly are positioned in the terminal-receiving grooves when the rotary member is turned in the first direction in the predetermined angle.

2. The apparatus of claim 1, wherein the plug terminal assembly has first and second ends, wherein in the first state the first end electrically connects to the power supply.

3. The apparatus of claim 1, wherein the second case further comprises a boss portion extending upward from an inner surface of the second case in relationship with the insertion opening, wherein the boss portion and the insertion opening are co-centric.

4. The apparatus of claim 3, further comprising connection plates installed at the boss portion.

5. The apparatus of claim 1, wherein a finger insertion groove is formed proximal to at least one of the terminal-receiving grooves.

6. The apparatus of claim 1, wherein the plug terminal assembly comprises:

at least two elongated electric terminals each having a terminal end collapsible into the slots of the rotary member in the second state; and a shaft connecting the at least two elongated electric terminals and rotatably inserted in a shaft groove of the rotary member.

7. The apparatus of claim 6, wherein:

a groove is formed proximal to a middle portion of the shaft, and a protrusion is formed at the rotary member to correspond to the groove to provide a stop to prevent further rotation of the rotary member.

8. The apparatus of claim 6, further comprising:

a boss portion disposed on the inside of the second case;

connection plates installed at the boss portion;

a first connection protrusion formed at a first end of the each of the at least two elongated electric terminals opposite the terminal ends, and a second connection protrusion formed at each of the connection plates to correspond to the first connection protrusion of the each of the at least two elongated electric terminals.

9. The apparatus of claim 8, wherein if the plug terminal assembly is in the first state, the first connection protrusion of the each of the at least two elongated electric terminals comes in contact with the second connection protrusion of the each of the connection plates.

10. The apparatus of claim 8, wherein if the plug terminal assembly is in the second state, the each of the at least two elongated electric terminals partially collapses in the insertion opening of the first case.

11. The apparatus of claim 1, wherein the first case further comprises:

a stopping groove formed inside the first case near the insertion opening, a stopper is formed at an outer circumferential surface of the rotary member to correspond to the stopping groove to restrict an angle of rotation of the rotary member.

12. The apparatus of claim 1, further comprising a flange formed around an outer circumference of the rotary member.

13. A collapsible plug assembly comprising:

a first case having an insertion opening and a plurality of terminal-receiving grooves extending from an inner circumference of the insertion opening;

a second case coupled to the first case to form a receiving space;

a boss portion extended from inside the second case to correspond with the insertion opening;

a rotary member rotatably inserted in the insertion opening and having slots formed on at least one surface to align with the terminal-receiving grooves of the first case when the rotary member is turned in a first direction in a predetermined angle; and a plug terminal assembly installed in the rotary member so that in a first state the plug terminal assembly is positioned approximately vertically upward in relation with a top surface of the first case, and in a second state the plug terminal assembly collapses to an approximately horizontal position in relation to the top surface of the first case such that terminal ends of the plug terminal assembly are positioned in the terminal-receiving grooves when the rotary member is turned in the first direction in the predetermined angle.

14. The apparatus of claim 13, wherein the plug terminal assembly has first and second ends, wherein in the first state the first end electrically connects to the power supply.

15. The apparatus of claim 13, further comprising connection plates installed at both sides of the boss portion and connected to a printed circuit board.

16. The apparatus of claim 13, wherein a finger insertion groove is formed proximal to at least one of the terminal-receiving grooves.

17. The apparatus of claim 13, further comprising a terminal support member installed within the boss portion to rotatably support the plug terminal assembly.

18. The apparatus of claim 13, wherein the plug terminal assembly comprises:

at least two elongated electric terminals each having a terminal end collapsible into the slots of the rotary member in the second state; and a shaft connecting the at least two elongated electric terminals and rotatably inserted in a shaft groove of the rotary member.

19. The apparatus of claim 18, wherein:

a groove is formed proximal to a middle portion of the shaft, and a protrusion is formed at the rotary member to correspond to the groove to provide a stop to prevent further rotation of the rotary member.

20. The apparatus of claim 18, further comprising:

connection plates installed at the boss portion;

a first connection protrusion formed at a first end of the each of the at least two elongated electric terminals opposite the terminal ends, and a second connection protrusion formed at each of the connection plates to correspond to the first connection protrusion of each of the at least two elongated electric terminals.

21. The apparatus of claim 20, wherein if the plug terminal assembly is in the first state, the first connection protrusion of the each of the at least two elongated electric terminals comes in contact with the second connection protrusion of the each of the connection plates.

22. The apparatus of claim 20, wherein if the plug terminal assembly is in the second state, the each of the at least tow elongated electric terminals partially collapses in the insertion opening of the first case.

23. The apparatus of claim 13, further comprising:

a stopping groove formed inside the first case near the insertion opening, and a stopper formed at an outer circumferential surface of the rotary member to correspond with the stopping groove so that a rotation angle of the rotary member is restricted.

24. The apparatus of claim 13, further comprising a flange formed around an outer circumference of the rotary member.

* * * * *